United States Patent [19]

Young

[11] 3,961,392

[45] June 8, 1976

[54] CLEANING DEVICE FOR SHOWER ENCLOSURE TRACKS

[75] Inventor: Charles C. Young, Fresno, Calif.

[73] Assignee: Kenneth Fleeman, Exeter, Calif.

[22] Filed: June 5, 1975

[21] Appl. No.: 584,113

[52] U.S. Cl. ..... 15/105; 15/111; 15/160; 15/176; 15/209 D; 15/210 R

[51] Int. Cl.[2] ..... A47L 13/12; A47L 25/00

[58] Field of Search ..... 15/105, 111, 114, 209 C, 15/209 D, 210; 51/181 R, 400; 401/9

[56] References Cited

UNITED STATES PATENTS

| | | | |
|---|---|---|---|
| 2,938,223 | 5/1960 | Horowitz | 15/209 D |
| 3,113,335 | 12/1963 | Baicker | 15/209 D X |

FOREIGN PATENTS OR APPLICATIONS

| | | | |
|---|---|---|---|
| 341,397 | 10/1921 | Germany | 15/209 D |
| 589,226 | 12/1933 | Germany | 15/210 R |

*Primary Examiner*—Daniel Blum
*Attorney, Agent, or Firm*—Huebner & Worrel

[57] ABSTRACT

A cleaning device particularly suited for use in removing encrusted residue from metallic surfaces, exemplified by surfaces of aluminum channel shaped tracks provided for supporting sliding doors defining a shower enclosure including interchangeable components particularly adapted for use in scraping encrustation from aluminum surfaces, scouring the residual encrustation, without inducing discoloration and thereafter polishing the aluminum surfaces.

3 Claims, 7 Drawing Figures

CLEANING DEVICE FOR SHOWER ENCLOSURE TRACKS

BACKGROUND OF THE INVENTION

1. Field of the Invention

The invention generally relates to cleaning devices and more particularly to an improved cleaning device particularly suited for use in removing encrustation from tracks for shower doors and the like.

2. Description of the Prior Art

As can readily be appreciated by those familiar with cleaning procedures adopted by those engaged in rendering janitorial services for commercial concerns such as hotels, motels, and the like, a great deal of difficulty often is encountered in maintaining the surfaces of tracks of shower doors in a condition such that the tracks appear to be bright and sparkling for thus rendering the facilities occupied by tenants pleasant in appearance.

Tracks for shower doors, and similar "bright-work" often are formed of aluminum materials, the surfaces of which tend to oxidize rather rapidly and form layers of encrustation as soaps, water, and other residue normally present in areas exposed to shower facilities are deposited thereon.

Of course, such encrustation formed within the tracks of shower doors presents a particularly perplexing problem for those engaged in cleaning and polishing bright-work. This results from the fact that where a non-metallic brush, such as a brush having nylon or straw bristles, is employed in the removal of encrusted residue, the bristles lack sufficient rigidity to penetrate the surface of the encrustation. On the other hand, where brushes having metallic bristles are employed, the aluminum surfaces tend to darken as a result of vigorous scouring. Where sharp metallic blades are employed, the surfaces are marred by scouring.

Hence, those engaged in polishing bright-work in commercial facilities such as hotels, motels and the like, often are faced with the unsatisfactory alternatives of leaving the encrustation undisturbed or cleaning the encrustation from the tracks of shower doors leaving the tracks with a darkened and/or scarred surface.

While various cleaning compounds have been suggested for use as a solution to these problems, the use of such has met with only varying degrees of success and, generally, have not eliminated the need for scouring surfaces to be cleaned.

It is, therefore, a general purpose of the instant invention to provide an improved cleaning device particularly suited for use in removing encrusted residue from metallic surfaces exemplified by the surfaces of tracks of aluminum and provided for supporting sliding doors employed to define enclosures such as shower stalls and the like.

OBJECTS AND SUMMARY OF THE INVENTION

It is an object of the instant invention to provide an improved cleaning device which overcomes the aforementioned difficulties and disadvantages.

It is another object to provide an improved cleaning device having interchangeable components which, collectively, serve as a cleaning device having a capability for removing encrustation formed on surfaces of aluminum materials.

It is another object to provide an improved cleaning device having a plurality of interchangeable components for use in cleaning and polishing surfaces of bright-work formed of aluminum in bathrooms found in hotels, motels, and the like.

Another object of the invention is to provide an improved cleaning device which is particularly suited for use in connection with the cleaning of surfaces of tracks formed of aluminum and provided for supporting shower doors in sliding engagement, although not necessarily restricted thereto, since the device has utility when employed in cleaning other surfaces formed of other materials, such as the surfaces of bright-work formed of steel, polyvinyl chloride and the like.

These and other objects and advantages are achieved through the use of an improved cleaning device characterized by a plurality of interchangeable components, including an elongated handle suitably configured to receive therein, alternatively, a rigid backbone for a scraper particularly suited for fracturing an encrustation of residue deposited on an aluminum surface, a scouring device for use in removing from the surface fractured residual encrustation, without inducing discoloration, and a bristle brush for polishing the metallic surfaces subsequent to a removal of the encrustation, as will become more readily apparent by reference to the following description and claims in light of the accompanying drawings.

DESCRIPTION OF THE PREFERRED EMBODIMENT

Figure 1:
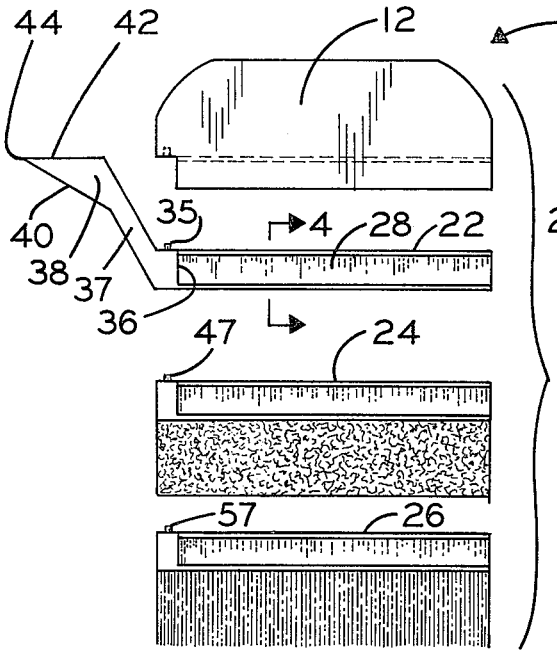
FIG. 1 comprises an exploded, composite view illustrating components of a device which embodies the principle of the instant invention including a handle, a scraper, a scouring device and a bristle brush.
Figure 2:
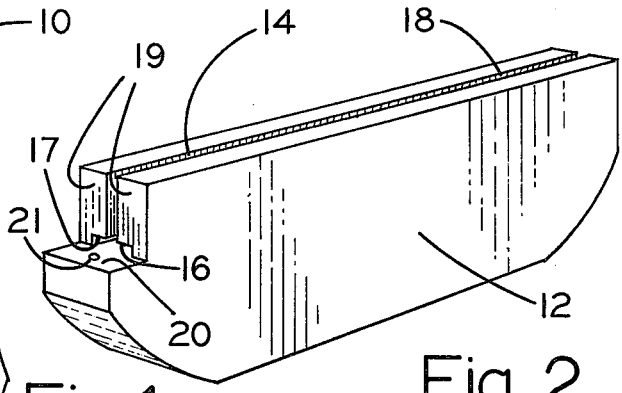
FIG. 2 comprises a perspective view of the handle, the orientation thereof being inverted with respect to the orientation illustrated in FIG. 1.
Figure 3:
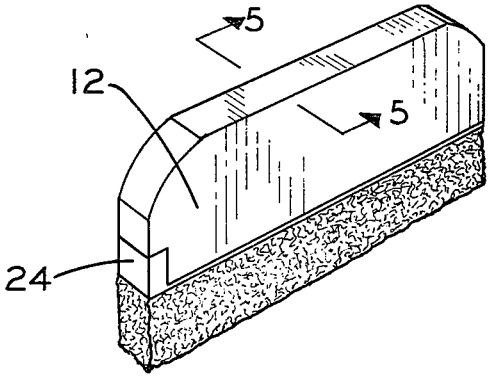
FIG. 3 is a perspective view of the device illustrating the handle and the scouring body mated into an integrated relationship.
Figure 4:
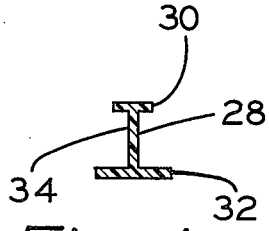
FIG. 4 is a cross-sectional view taken generally along line 4—4 of FIG. 1.
Figure 5:
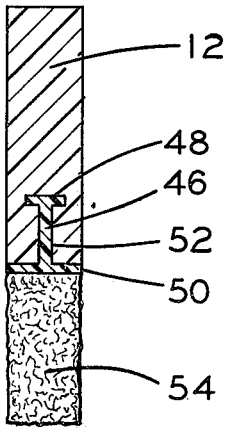
FIG. 5 is a cross-sectional view taken generally along line 5—5 of FIG. 3.
Figure 6:
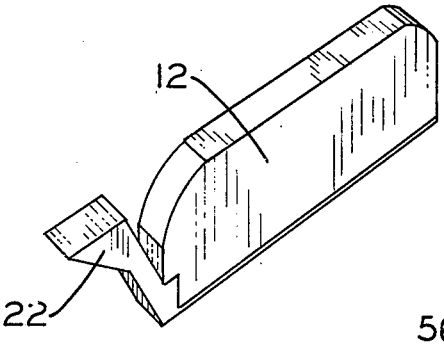
FIG. 6 is a perspective view illustrating the handle and scraper mated in an integrated relationship.
Figure 7:
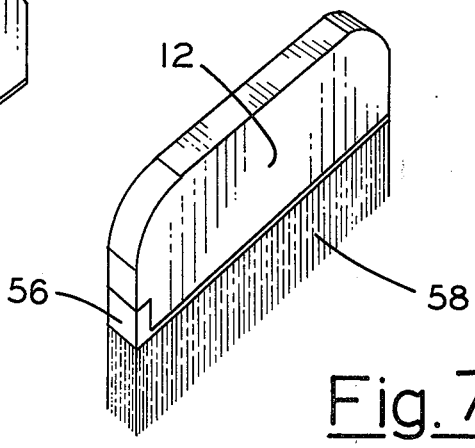
FIG. 7 is a perspective view of the device illustrating the handle and bristle brush mated in an integrated relationship.

Referring now to the drawings wherein like reference characters designate like or corresponding parts throughout the several views, there is shown in FIG. 1 a device 10 which embodies the principles of the instant invention.

As illustrated in the drawings, the device 10 includes a handle 12 configured to be received in the palm of a user's hand. As a practical matter, the handle 12 is characterized by a length greater than its depth and a depth greater than its width. While the handle 12 is, where so desired, fabricated from wood, it is to be understood that other materials, including polyvinyl chloride, serves quite satisfactorily for this purpose.

The handle 12 along the lowermost edge surface thereof is provided with a slot, designated 14. This slot is characterized by a cross section of a T-shaped configuration, whereby a pair of transversely oriented shoulder surfaces 16 and 17 are provided in mutually spaced, coplanar relation separated by an elongated opening 18 oriented in a plane normally related to the plane of the shoulder. The end of the handle 12 preferably is relieved to provide a notch, not designated, having a pair of end surfaces 19 disposed in a plane transversely related to both the plane of the shoulders and the plane of the opening 18, and a base surface 20 defined in a plane extended in parallelism with the plane of the shoulders and normally related to the plane of the surfaces 19.

Within the base surface 20 there is provided a blind bore 21 which functions as a locking detent for alternatively securing in place a series of components including a scraper 22, a scouring body 24 and a bristle brush 26 as the components are sequentially mated with the handle 12 and collectively employed in performing a cleaning function, as will hereinafter be more fully understood.

The scraper 22 includes a backbone 28 having a cross section substantially conforming to a T-shape configuration, similar in both shape and dimension to that of the slot 14. The backbone 28 of the scraper preferably is formed of an extruded synthetic resin and includes a transverse member 30 and a planar body 32 integrally related through a connecting web 34. The combined depth of the web 34 and member 30, as well as the thickness thereof is substantially equal to the depth and width of the elongated opening 18. Thus the backbone 28 of the scraper is suitably configured for axial insertion into the slot 14 for thus mating the handle 12 and the scraper 22 in an integrated relationship.

In order to assure that an integrated relationship for the scraper and the handle is maintained, the backbone 28 is provided with a protuberance 35 which is configured to seat within the locking detent formed by the bore 21, once the backbone 28 is fully seated in the slot 14 of the handle 12.

Additionally, it is noted that the backbone 28 also is provided with a pair of laterally spaced shoulders 36 disposed in a plane transversely related to the longitudinal axis of the backbone 28 and adapted to mate with and seat against the surfaces 19, once the backbone is seated within the handle 12. Thus, the backbone is substantially "locked" in a releasable configuration within the handle 12. It will, of course, be appreciated that the material from which the scraper 22 is fabricated has a coefficient of resiliency such that the backbone 28 accommodates deflection sufficient for disengaging the protuberance 35 from the detent formed by the bore 21.

From one end of the backbone 28, preferably in juxtaposition with the shoulders 36, there is extended an integrally related leg 37 which terminates in an angularly configured foot 38. The foot 38 includes a pair of angularly related faces 40 and 42 which intersect at a suitable angle to form a knife edge 44 having sufficient rigidity to penetrate encrustation to be removed from metallic surfaces. It should, therefore, be apparent that it is possible to penetrate, fracture and substantially remove encrustation deposited on surfaces to be cleaned through a vigorous manipulation of the scraper 22. Moreover, it is important to note that transverse dimension of the foot is preferably determined by the transverse dimension of those tracks having surfaces to be cleaned.

Once the encrustation has been fractured and partially removed, through a manipulation of the scraper 22, it is desirable to scour the surface for thus removing residual encrustation, without darkening the metallic surface thereof. This is, in practice, achieved through the use of the scouring body 24.

The scouring body 24 is provided with a backbone 46, similar in design to the backbone 28. The backbone 46 includes a transverse member 48, a planar body 50 and a web 52 which serves to integrate the planar body 50 and the transverse member 48 into an integrated relationship. The purpose of the backbone 46 is to couple the scouring body 24 with the handle, therefore, adhered to one face of the planar body 50, opposite the web 52, there is a scouring pad 54 formed from a rigid pressed polyester fiber, the rigidity of which is sufficient to remove fractured residual encrustation from the metallic surface to be cleaned as a scouring of the metallic surfaces is effected manually.

Of course, the scouring pad 54 is adhered to the backbone 46 through the use of suitable adhesives, including epoxy resins and the like. Further, the scouring pad 54 also is suitably dimensioned to be received by channel shaped tracks for shower doors and the like.

It should readily be apparent that once the scraper 22 has been employed for fracturing the encrustation to be removed, the scouring body is employed for removing residual encrustation from the surfaces being cleaned.

In practice, it is desirable to complete the cleaning of the aluminum surfaces through a brushing operation. Therefore, once the encrustation has been removed, it is often desirable to polish the surface being cleaned employing a brush having bristles formed of non-metallic substances. The bristle brush 26 is provided for this purpose.

The bristle brush 26 also includes a backbone, designated 56, similar in design and function to the backbones 28 and 46. Therefore, a detailed description of the backbone 56 is omitted in the interest of brevity. However, it is to be understood that from the backbone 56 there is projected a plurality of bristle tufts 58. The tufts 58 are formed from a suitable non-metallic material, such as a synthetic resin or, where so desired, suitable fibrous materials and connected with the backbone 56 in a suitable manner, such as through a use of an epoxy resin and the like. In any event, it is to be understood that the bristle tufts 58 are non-metallic and thus have substantially no deleterious effects on the aluminum surfaces of aluminum being cleaned, as the surfaces are brushed employing the bristle brush 26 coupled with the handle 12 in a manner similar to that in which the scraper 22 and scouring body 24 are connected with the handle.

Since the scraper 22, scouring body 24 and bristle brush 26 comprise interchangeable components for the device 10, it is to be understood that these components are, where desired, supplied as replacement components for the device 10 as the previously employed components are damaged or are simply worn out through usage.

OPERATION

It is believed that in view of the foregoing description, the operation of the device will readily be understood and it will be briefly reviewed at this point.

The device 10 is initially assembled with the scraper 22 being mated with the handle 12 in an integrated relationship. In this configuration, the device 10 is employed for scraping encrustation from selected surfaces, such as the surfaces of aluminum tracks provided for sliding doors, employed in forming shower enclosures.

Of course, through a vigorous scraping and similar manipulation of the scraper 22, the encrustation is fractured and a substantial quantity thereof is removed from the surface to be cleaned. In order to remove residual encrustation, the scraper 22 is disassociated from the handle 12, of the device 10, and the scouring body 24 next is mated therewith, simply by inserting the backbone 46 in the slot 14. The device 10 is thus prepared for performing a scouring function. Once scouring of the surface to be cleaned is completed, it is highly desirable to remove fragments of encrustation now present on the surface, certain portions of which may be adhered only slightly to the surface being operated upon. Therefore, the scouring body 24 is removed and replaced by the bristle brush 26, through an insertion of the backbone 56 into the elongated slot 14 with the protuberance 35 thereof being seated in the detent formed by the bore 21. A final polishing through a vigorous brushing of the surface is thus facilitated.

In view of the foregoing, it should readily be apparent that the device of the instant invention provides a practical solution to the perplexing problem of cleaning and polishing aluminum surfaces, such as those commonly found in tracks provided for supporting sliding doors which form shower enclosures, without darkening or otherwise impairing the appearance thereof.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. In a cleaning device particularly suited for use in removing encrusted residue from metallic surfaces exemplified by the surfaces of channel shaped tracks formed of aluminum and provided for supporting sliding doors defining an enclosure for a shower, the improvement comprising:

A. an elongated handle characterized by a depth greater than the width thereof having an elongated slot extended along one surface and characterized by a cross section of a T-shape configuration, and a detent disposed in axial alignment with said slot for receiving a locking protuberance; and B. a scouring body suitably dimensioned to be received by the tracks for removing residual encrustation from said metallic surface comprising an elongated backbone characterized by a portion having a cross section of T-shape configuration and adapted to be inserted axially into said slot, means including a locking protuberance projected from said backbone and adapted to be received by said detent for securing the backbone against axial displacement relative to said slot, and a pad of pressed polyester fiber adhered to said backbone and projecting therefrom.

2. An improved cleaning device particularly suited for use in removing encrusted residue from metallic surfaces exemplified by the surfaces of channel shaped tracks formed of aluminum and provided for supporting sliding doors defining an enclosure for a shower comprising:

A. an elongated handle characterized by a depth greater than the width thereof having an elongated slot extended along one surface and characterized by a cross section of a T-shape configuration, and a detent disposed in axial alignment with said slot for receiving a locking protuberance;

B. interchangeable components including a scraper unit for fracturing encrustation deposited on a metallic surface comprising an elongated first backbone characterized by a portion having a cross section of T-shape configuration adapted to be inserted axially into said slot, means including a locking protuberance projected from one surface of said first backbone and adapted to be received in said detent for securing the first backbone of said scraper against axial displacement relative to said slot, and a rigid foot angularly projecting from the first backbone including an inclined face adapted for use in forcibly penetrating said encrustation;

C. a scouring body for removing residual encrustation from said metallic surface comprising an elongated second backbone characterized by a portion having a cross section of T-shape configuration and adapted to be inserted axially into said slot, means defining a locking protuberance projected from said second backbone and adapted to be received in said detent for securing the second backbone against axial displacement relative to said slot, and a pad of pressed polyester fiber adhered to said second backbone and projecting therefrom; and D. a bristle brush for polishing said metallic surface comprising a third backbone characterized by a portion having a cross section of T-shape configuration and adapted to be inserted axially into said slot, means including a locking protuberance adapted to be received in said detent for securing the brush against axial displacement, and a plurality of bristle tufts projecting from said third backbone.

3. The device of claim 2 wherein said handle includes means defining an abutment shoulder in juxtaposition with one end of said slot and each of said backbones includes a projection including a face adapted to engage said shoulder.

* * * * *